United States Patent [19]

Weaver et al.

[11] Patent Number: 5,014,040

[45] Date of Patent: May 7, 1991

[54] PERSONAL LOCATOR TRANSMITTER

[75] Inventors: Philip W. Weaver, Kanata; Kamal Fakhry, Ottawa; Shin Saito, North Vancouver , all of Canada

[73] Assignee: Instantel Inc., Canata, Canada

[21] Appl. No.: 422,028

[22] Filed: Oct. 16, 1989

[30] Foreign Application Priority Data

Oct. 14, 1989 [CA] Canada ..... 580282

[51] Int. Cl.[5] ..... G08B 13/14

[52] U.S. Cl. ..... 340/572; 340/539; 340/573

[58] Field of Search ..... 340/572, 573, 539

[56] References Cited

U.S. PATENT DOCUMENTS

| | | | |
|---|---|---|---|
| 3,972,320 | 8/1976 | Kalman | 340/573 |
| 4,063,410 | 12/1977 | Welling | 340/573 |
| 4,694,284 | 9/1987 | Leveille et al. | 340/573 |
| 4,736,196 | 4/1988 | McMahon et al. | 340/573 |
| 4,812,823 | 3/1989 | Dickerson | 340/572 |
| 4,819,860 | 4/1989 | Hargrove | 340/573 |

*Primary Examiner*—Joseph A. Orsino
*Assistant Examiner*—Geoff Sutcliffe
*Attorney, Agent, or Firm*—Antonelli, Terry, Stout & Kraus

[57] ABSTRACT

A personal locator transmitter adapted to be worn on the wrist and having the size and appearance of a conventional wrist-watch. This transmitter is provided with a programmable memory, a transmitter controlled by the memory, an antenna for reliably radiating signals from the transmitter regardless of orientation of the wrist of a user and including both a manually operable alarm activated by pressing a button, and an automatic alarm actuated by an attempt to remove the unit from the wrist of the wearer. The unit is controlled by a control memory comprised of an EEPROM encoded with unique identification codes and other information as required in the specific application.

6 Claims, 7 Drawing Sheets

| CASE # | GROUP I | | | GROUP II | | GROUP III | |
|---|---|---|---|---|---|---|---|
| B @ 2.8KB TIME (ms) | 32C 11.42 | 16C 5.71 | 8C 2.86 | 16C 5.71 | 8C 2.86 | 16C 5.71 | 3072C 1096.70 |
| B @ 1.4KB TIME (ms) | 16C 11.42 | 16C 11.42 | 4C 2.86 | 16C 11.42 | 4C 8.26 | 16C 11.42 | 1536C 1097.16 |
| C @ 2.8KB TIME (ms) | 32C 11.42 | 21C 7.5 | 8C 2.86 | 21C 7.5 | 8C 2.86 | 21C 7.5 | 3072C 1096.70 |
| C @ 1.4KB TIME (ms) | 16C 11.42 | 21C 15.0 | 4C 2.86 | 21C 15.0 | 4C 2.86 | 21C 15.0 | 1536C 1097.16 |
| D @ 2.8KB TIME (ms) | 32C 11.42 | 24C 8.57 | 10C 3.57 | 24C 8.57 | 10C 3.57 | 24C 8.57 | 3072C 1096.70 |
| D @ 1.4KB TIME (ms) | 16C 11.42 | 24C 17.14 | 5C 3.57 | 24C 17.14 | 5C 3.57 | 24C 17.14 | 1536C 1097.16 |
| D @ 1.4KB TIME (ms) | 16C 11.42 | 24C 17.14 | 5C 3.57 | 24C 17.14 | 5C 3.57 | 24C 17.14 | 16384C 11703.09 |
| E @ 2.8KB TIME (ms) | 32C 11.42 | 27C 9.64 | 12C 4.28 | 27C 9.64 | | | 32768C 11698.17 |
| E @ 1.4KB TIME (ms) | 16C 11.42 | 27C 19.29 | 6C 4.28 | 27C 19.29 | | | 16384C 11703.09 |

(DIAGRAM NOT TO TIME SCALE)

PERSONAL LOCATOR TRANSMITTER

The present invention relates to a personal locator transmitter. Personal locator transmitters (PLT's) are used for locating and monitoring humans in special circumstances. PLT's are intended to be worn by the person being monitored and to provide an indication of their whereabouts and, in particular, to indicate if such persons have passed through doorways or gates equipped with sensors to detect the presence of such persons at such doorways or gates.

PRIOR ART

Several patents have been granted on personal locator devices and systems to locate or monitor a condition of a patient and for transmitting information to identify a particular patient whose transmission is being sent; see for example the teachings of Kalman, U.S. Pat. No. 3,972,320; or Shnug, U.S. Pat. No. 4,314,240.

U.S. Pat. No. 4,598,275 to Ross et al of July 1, 1986 discloses a monitoring system for individually identifying a person. The system includes a central information processor, a signal receiver, remote detectors in various locations and normally non-transmitting individual personalized portable identifiers, each of which transmits a personalized coded identification signal when interrogated by a remote detector. This transponder system is intended for identification of patients in hospitals as the personalized portable unit can be contained in a wristband. The centralized information storage console receives a composite signal identifying the detector module and thus its location as well as the identity of the unit responding to the detector module. This console can include a separate portable or visual warning system such as a warning buzzer or a light. The remote detector modules may be located at entrances and exits to various areas within a building and each detector module includes an antenna which functions to emit interrogation signals which are received by a receiver in the identifier units, which are then activated to radiate their identity code. This code is received in the detector module. The identifier unit also includes an individual digital encoder and pulse code modulator.

Shirley, U.S. Pat. No. 4,682,155 teaches a security sensing system which monitors the passages of persons through a door or like opening, the system being particularly useful in nursing homes for the aged, institutions for mentally incompetent persons and similar places where there is a need to alert the staff to any unauthorized departure of a resident through a door. The Shirley system activates an alarm means at a remote station to alert persons on duty that one of the residents is passing through an unauthorized doorway. Individual identification is also provided for by the Shirley patent.

Carroll et al, U.S. Pat. No 4,549,264 of Oct. 22, 1985 teaches a system for a hospital wherein a transmitting unit may be physically attached to the wrist of a patient and the transmitting unit transmits a uniquely coded signal every 15 seconds. A portable self-contained transceiving unit is worn by selected hospital personnel, such as nurses or doctors, which has a memory for time-logging information whenever the portable unit comes within a specified distance of any one of the transmitting units for a specified period of time. The purpose of this system is to track the time spent by professionals with patients for billing purposes.

Wrist mounted transmitters are disclosed by Narcisse, U.S. Pat. Nos. 4,593,273 and 4,675,656; Vogelman et al, U.S. Pat. No. 3,572,316; Schwitzgebel et al, U.S. Pat. No. 3,478,344; and Court, U.S. Pat. No. 4,372,444. The Narcisse system sounds an alarm when a patient travels beyond a predetermined distance. Vogelman et al is used to monitor physiological parameters of a patient. Schwitzgebel et al is used to analyze and/or supervise the behaviour of selected individuals. Court includes an antenna loop comprising an etched circuit trace extending around the periphery of a printed circuit board. Other patents related to this technology include Man, U.S. Pat. No. 4,706,689; Dill, U.S. Pat. No. 4,684,933; Yokoi et al, U.S. Pat. No. 4,709,330; Miller, U.S. Pat. No. 3,609,741; and Akerberg, U.S. Pat. No. 4,347,501.

BRIEF DESCRIPTION OF THE INVENTION

The present invention relates to improvements over the teachings of the above patents in providing a small, reliable and efficient personal locator transmitter adapted to be worn on the wrist and having the size and appearance of a conventional wrist-watch. This transmitter is provided with a programmable memory, a transmitter controlled by the memory, an antenna for reliably radiating signals from the transmitter regardless of orientation of the wrist of a user, and including both a manually operable alarm activated by pressing a button, and an automatic alarm in the event that an attempt is made to remove the unit from the wrist of a wearer.

In accordance with the present invention there is provided a personal locator transmitter that is easy to use, highly reliable, unique in its way of identifying itself and able to transmit a call for help. This unit is carried on the wrist or ankle by the patient or user. If the user crosses the active area of a receiving antenna, a receiver associated therewith signals a central control station indicating the area or exit that has been crossed and displaying the identification number of the particular transmitter. It is thus evident that regular control of the transmitter is necessary and the personal locator transmitter of the present invention thus consists of two main parts, the control memory and the transmitter. These components are packaged in a modular form very similar to a wrist-watch, however, the specific packaging can be modified to suit specific application requirements.

In accordance with a preferred rom of the invention the control memory is comprised of an EEPROM (Electrically Erasable Programmable Read Only Memory). The EEPROM is driven by an oscillator running, for example, at 5.6 KHz to regularly provide a readout of the memory on two outputs, a transmit enable output and a data output. The transmit enable output regularly turns the transmitter on and off, and during the on-time the data is then encoded on the transmission. A variety of possible codings may be stored in the EEPROM providing data readouts at sub-multiples of the oscillator frequency and including various bits of data programmed uniquely to identify the personal locator transmitter. The unit offers a wide choice of coding and repetition times as well as providing for variation in the number of bits in any code group.

In accordance with an aspect of the invention, one form of transmitter utilizes frequency shift keying to transmit the digital data provided by the control memory. The transmitter oscillator may, for example, be crystal controlled for a frequency of 54.25 MHz and the frequency shift modulates the main frequency by 900

Hz upon receiving a digital pulse from the memory. In one form of transmitter, two multiplier stages step up the basic frequency to 217 MHz which is the carrier provided to the antenna. The frequency shift keying would accordingly be −3.6 KHz. In other words, the centre frequency of the antenna is 217 MHz with a logic 0 provided to the frequency shift control and 217 MHz −3.6 KHz=216.996400 MHz with a logic 1 provided to the frequency shift control. Advantageously, the multiplier stages operate in class C, serving also as driver or predriver for the antenna which may be base loaded to compensate for the physical dimensions of the antenna in order to enhance the power radiated thereby. Conveniently, changing the crystal in the transmitter will permit operation over a range of frequencies, for example, from 216 MHz to 220 MHz. Other operational frequencies can, of course, be readily obtained by means well known to those skilled in the art of transmitter design, including modification of the parts of the multiplier stages and varying the length and base loading of the antenna.

In normal use the transmitter under control of the memory is turned on for a brief period of time to enable the carrier to be present before data is feed to the transmitter. Then a plurality of sync pulses and special function bits will appear in a data stream followed by data bits which carry the personal locator transmitter ID number in binary format. These may be followed by a second code group and a third code group. Then the transmitter is turned off for a period of time allowing the batteries to rest, and extend the battery life. The time between transmission bursts can be varied but may advantageously be as frequent as one burst per second.

The usual power output radiated by the transmitter is an average of 1 mW. Such output can be increased by modifying the biasing on the second multiplier stage, by using an additional transistor as output driver also operating in class C, or by using a specially designed output buffer.

The personal locator transmitter of the present invention has a number of advantages over the known prior art. The unit is light in weight and small in size, no bigger than a wrist-watch. The transmitter can only be removed from the wrist by using a special key. If the strap is cut the transmitter sends a panic alarm. The person wearing the unit can call for help by pressing a button on its face. The unit can store very large identification numbers, allowing up to 2 million units on the same system. This enables a large number of users to be present in the same facility. The unit is easily programmable in the field. The time between transmission bursts can be varied for extended battery life and different applications.

In accordance with the invention, a special circular antenna is utilized which allows multi-plane propagation patterns. This is advantageous since an adequate RF signal is propagated regardless of the position of the wrist. Moreover, the unit of the present invention is provided with a back-plane so that body capacitance and other electrical effects can be minimized providing reliable signal propagation regardless of the ambient environment.

The unit is water-resistant and is accordingly capable of withstanding immersion in water for periods of time.

The personal locator transmission of the invention can be used for monitoring patients in hospitals, in old age care and in the protection of children from being abducted. In home alert applications, if the monitored individual wanders away, the receiver is capable of triggering the home security unit to dial a pre-selected telephone number or alert a control centre. The unit can also be applied in the trucking industry where the transmitter is carried on a truck and the receiver on the exit/entrance gate can record the times and which truck has moved through the gate.

The unit can also be used for house arrest situations in which the receiver would be listening to transmitter signals at all times. If the person under house arrest leaves the house, the receiver will alert the monitoring centre. The unit can also be used in mail security applications where the transmitter is hidden in a package so that it may be readily be tracked.

In drawings which illustrate an embodiment of the invention,

FIG. 1 is a plan view of a personal locator transmitter intended to be worn on the wrist, FIG. 2 is a perspective view illustrating the personal locator transmitter of the present invention with the strap locked into the casing, FIG. 3 is a side view on a slightly different scale of the personal locator transmitter of FIGS. 1 and 2, FIG. 4 is a partial cross-section of the transmitter of FIG. 3.

FIG. 5 is a plan view of the unit showing in phantom line the electrical contact embedded in the wrist strap, FIG. 6 is a fragmentary section through the electrical contact of the wrist band, FIG. 7 is a partial section through the case of FIG. 5 showing the electrical connection to the wrist strap, FIGS. 8, 9 and 10 illustrate the manner of attachment of the wrist strap through the case and illustrate the use of a separate key for permitting removal of the wrist strap, FIG. 11 is a block diagram of the electrical circuit of the personal locator transmitter, FIG. 12 is a schematic diagram of the personal locator transmitter, FIG. 13 is a functional diagram of the EEPROM of FIG. 11, and FIG. 14 is a timing diagram illustrating the operation of the programmable memory.

DETAILED DESCRIPTION OF THE INVENTION

Figure 1:
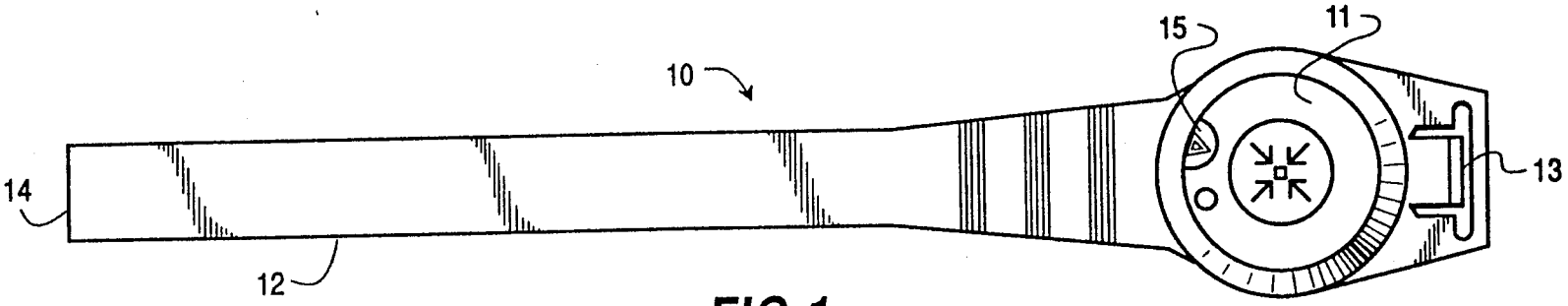
Figure 3:
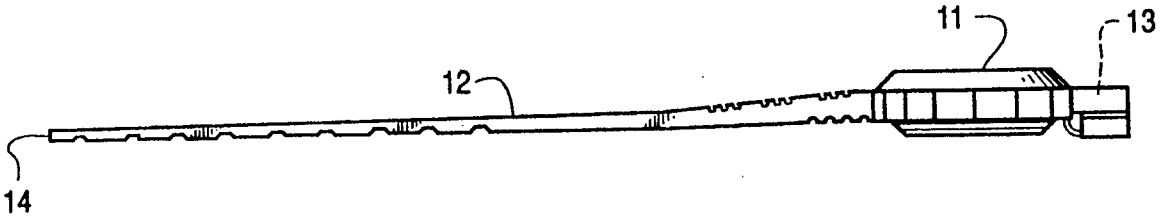
Figure 2:
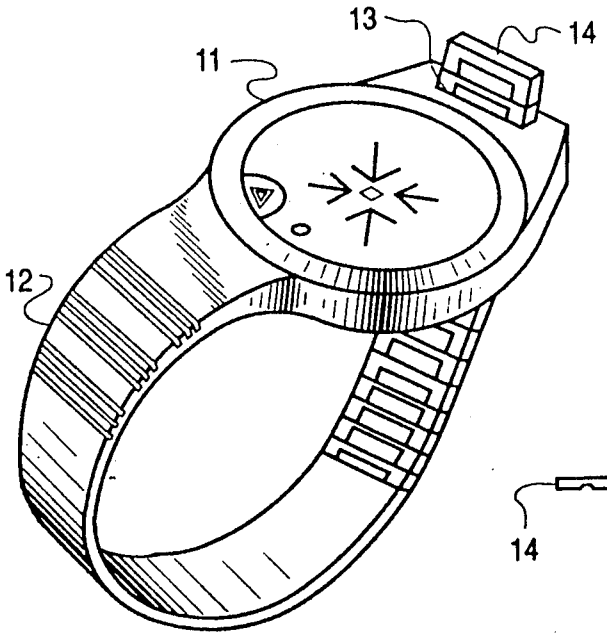

Referring to FIG. 1, 2 and 3 there is shown the exterior appearance of the personal locator transmitter of the present invention 10 and which, as can be seen, closely resembles the configuration of a conventional wrist-watch having a casing 11 in which the electronic components are housed and a wrist strap 12. As will be detailed below, the wrist strap 12 is integrally formed with the casing 11, which is provided with a suitably shaped opening 13 through which the free end 14 of the wrist strap may be inserted and locked in position by means described below.

The components in the casing 11 as will be discussed hereinafter include a printed circuit board on which are mounted a control memory and a transmitter, a battery providing power to drive the components mounted on the printed circuit board, an antenna of generally circular configuration fitted within the casing 11 and means for sealing the casing. With all components mounted in the casing 11 the battery energizes the electrical circuits causing the transmitter to transmit signals under the control of the control memory.

The casing 11 includes a button 15, which can be engaged to summon help by the sending of special codes from the transmitter.

Figure 4:
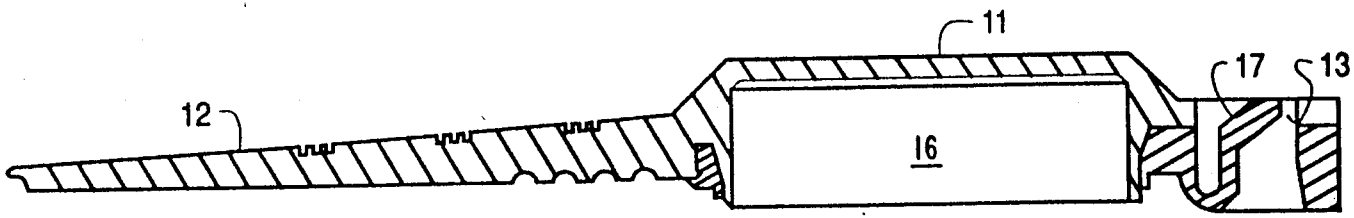

In FIG. 4, which is a cross-section through the casing 11 and strap 12, there may be seen the cavity 16 in which the electronic components, the battery and the antenna are mounted, as well as a cross-section through the latch mechanism 17 which serves to lock the free end 14 of the wrist strap 12 to prevent removal of the personal locator transmitter.

Figure 5:
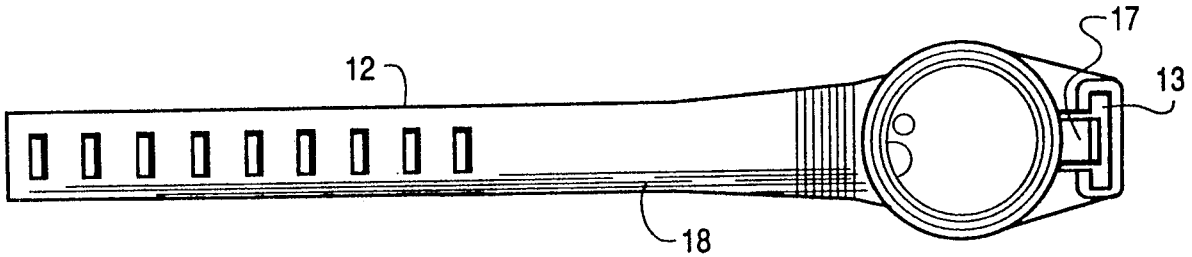
Figure 7:
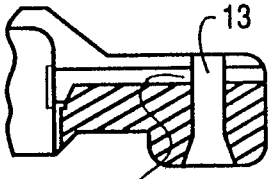

FIG. 5 is a plan view similar to FIG. 1 more clearly showing the position of the locking member 17 in relation to the opening 13. It may be noted in FIG. 5 that there is shown in dotted lines an electrical conductor 18 extending the length of the wrist band 12 and exposed along the lower edge of the wrist band for making contact with an electrical connection located in the opening 13 and shown at FIG. 7 as item 18.

Figure 6:
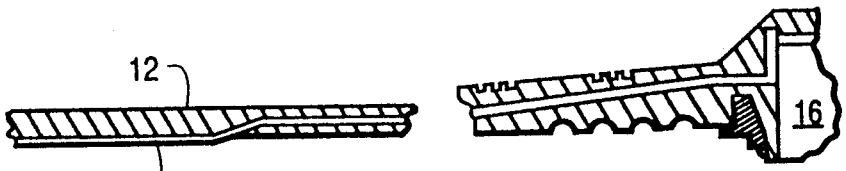

FIG. 6 illustrates in section the location of the electrical conductor 18 in the wrist band 12 and the electrical contact which extends within the cavity 16 to provide the electrical continuity for the wrist strap device.

Figure 10:
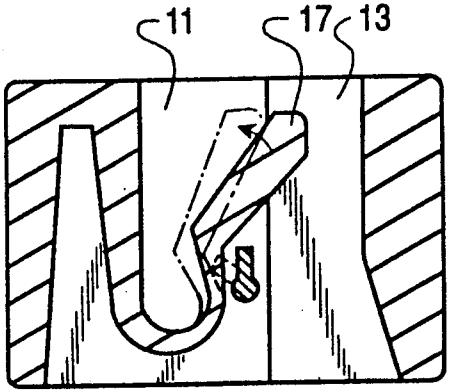
Figure 9:
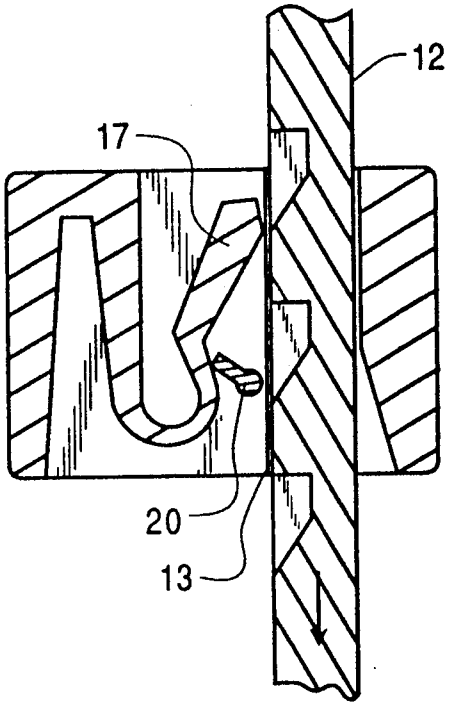
Figure 8:
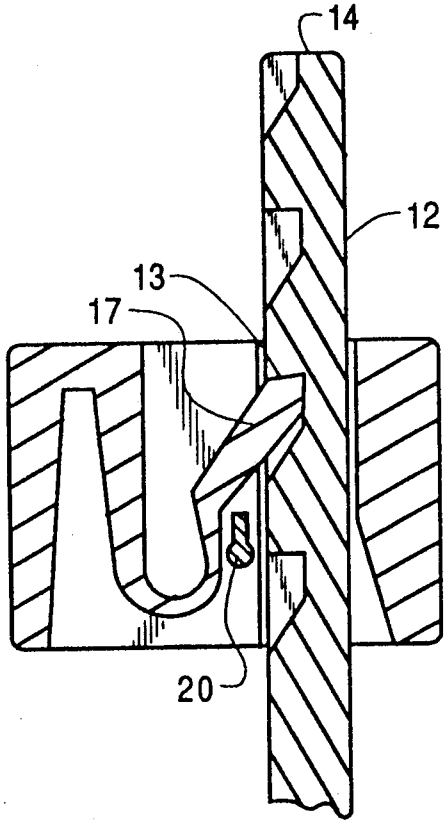

Referring to FIG. 8, 9 and 10 there is illustrated in section the free end 14 of the wrist band 12 extending through the slot 13 and held in position by the locking member 17. The components as illustrated in FIG. 8 are in the locked condition. FIG. 9 illustrates a separate key 20 inserted in the casing 11 adjacent the slot 13 to retract the locking part 17 thereby permitting removal of the wrist band 12 from the slot 13 in the casing 11. FIG. 10 illustrates the locking member 17 in its release position and in phantom lines in its retracted position illustrating that when the free end 14 of the wrist band 12 is inserted through the slot 13 the locking member 17 will ratchet to permit the band 12 to be tightened, and will then lock the band from removal. As noted with reference to FIGS. 5, 6 and 7, the insertion of the wrist band 12 through the slot 13 completes an electrical connection which would be broken if the wrist band were removed, causing an alarm of the unit.

Figure 11:
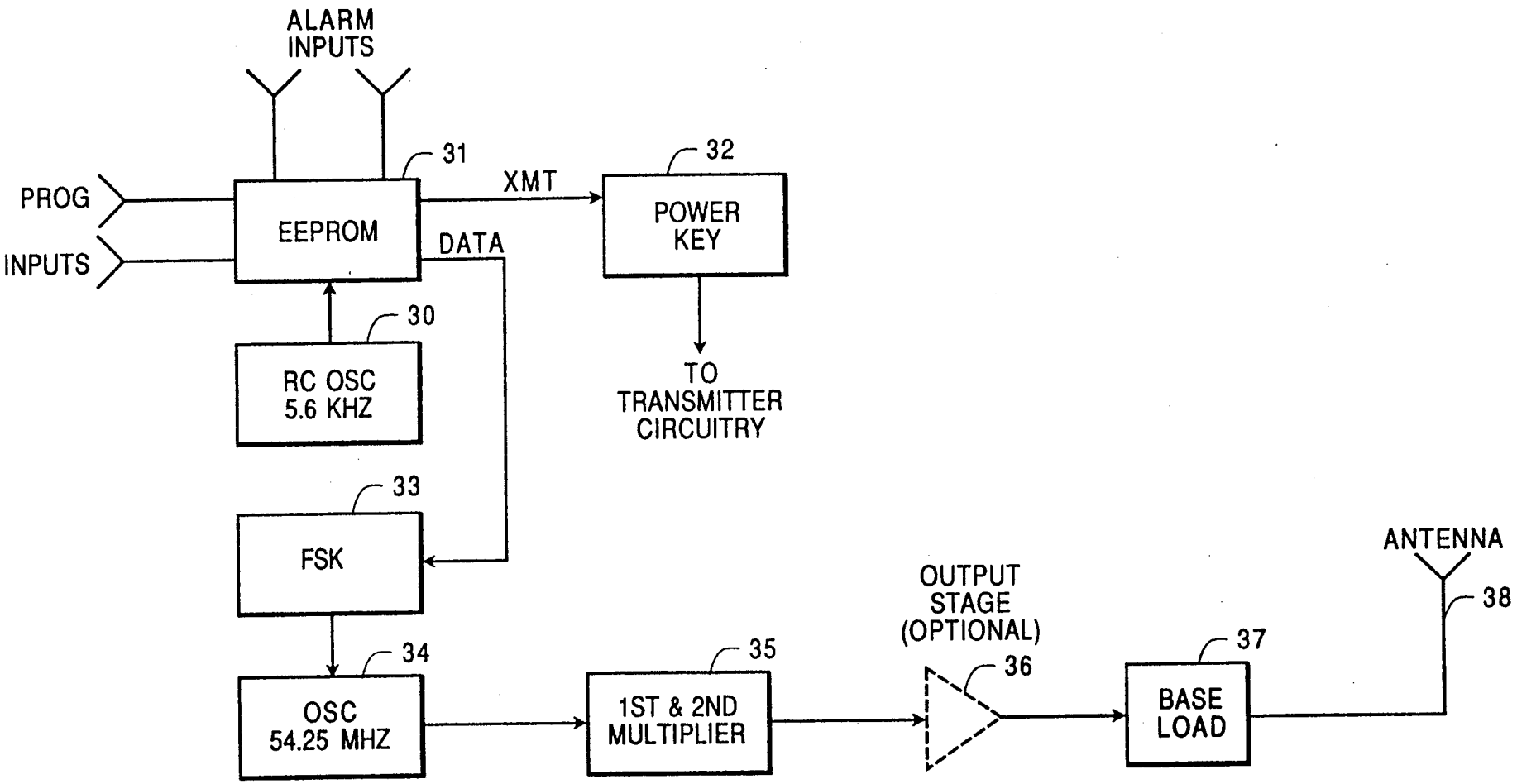

FIG. 11 illustrates the block diagram of the electrical circuitry contained in the personal locator transmitter including an oscillator 30 providing a clock signal to the EEPROM 31 which in turn drives a power key 32 to turn on the transmitter as described below. Data from the EEPROM 31 is fed to a frequency shift keyer 33 which modulates the output of a second oscillator 34 which drives first and second multiplier stages 35 which supplies output through an optional output stage 36 to a base load 37 of an antenna 38. The antenna radiates a signal at the predetermined frequency bearing data in frequency shift code, which can be picked up by any receiver in the immediate vicinity of the transmitter antenna 38.

The transmitter utilizes the frequency shift keying mode to transmit the digital data including the personal locator transmitter identification number. The oscillator 34 is typically running at a frequency of 54.25 MHz and the frequency shift keyer control shifts the main frequency by $-900$ Hz upon receiving a digital pulse, a high from the memory 31. The next two multiplier stages 35 step up the basic frequency to 217 MHz which is the carrier frequency of the present embodiment. The frequency shift keying is also multiplied and results in a frequency shift of $-900\times4=-3.6$ KHz. In other words, the unmodulated frequency of the transmitter is 217 MHz, and with maximum modulation is 216.996400 MHz. The maximum modulation occurs at the output of a logic 1 from a frequency shift keyer 33. The base loaded antenna 38 is pre-tuned, for example, to 217 MHz, and in a preferred embodiment consists of an antenna mounted within the cavity 16 of the case 11 (FIG. 4) the antenna extending around the perimeter of the cavity 16 to subtend an angle of approximately 300°. That is the antenna is shaped in a circular shape, conforming to the configuration of the interior of the casing 16, but the circular antenna does not form a closed loop, but rather subtends only an angle of approximately 300°.

The EEPROM 31 which is driven by the oscillator 30 is a custom made EEPROM fitted on a printed circuit board mounted within the circular cavity 16 along with the other transmitter components. The output from the EEPROM 31 consists of a first output which is fed to the power keyer 32 to turn on the transmitter, and the second is the actual data stored in the EEPROM which is fed to the frequency shift keyer 33 to modulate the transmitter output. The transmit enable output fed to the power key 32 turns the transmitter on and off in order to save power. During the on-time the data is then present at the data output.

In accordance with the present embodiment the EEPROM is programmable for different cases.

case B at 2.8 KHz (data rate)
case B at 1.4 KHz (data rate)
case C at 2.8 KHz (data rate)
case C at 1.4 KHz (data rate)
case D at 2.8 KHz (data rate)
case D at 1.4 KHz (data rate)
case D at 1.4 KHz (data rate)(longer time between transmission cycles)
case E at 2.8 KHz (data rate)
case E at 1.4 KHz (data rate)

The choices between these cases is governed by the time between the transmission bursts, the time of each code group, and the number of code groups per burst.

Figure 14:
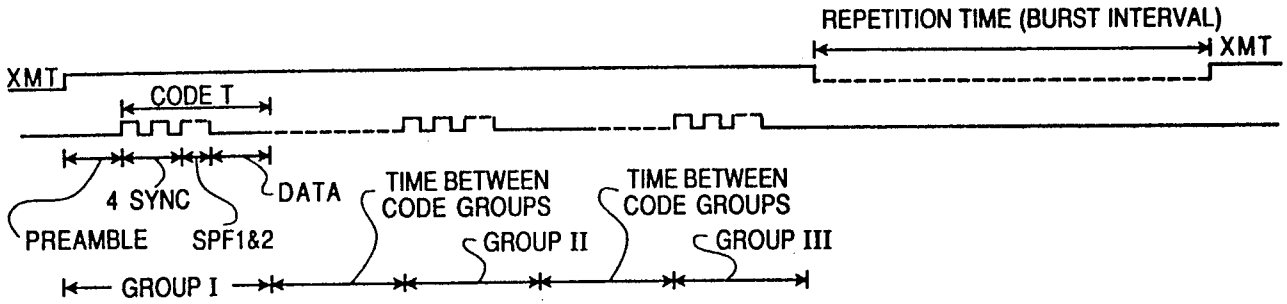

These cases are all clearly outlined by the timing diagram (FIG. 14). This timing diagram lists all cases in clock pulses and in milliseconds. As seen, it offers a wide choice of coding the repetition times, as well as the number of bits per code group. The EEPROM itself, as seen, in the block diagram consists of:

4 bits of sync pulses
2 bits of special function
21 bits programmable EEPROM cells
4 bits EEPROM case select A total of 31 bits, appearing on the output (in the read mode) as a serial stream of data. This EEPROM memory is only one bit wide.

The read cycle consists of the following stages in every transmission burst:

The Preamble: This is an initial time for the transmitter to have the carrier already in transmission before the data is introduced.

The 4 Bits: Sync Pulse: These bits are the first in the serial data stream to alert the receiver that valid data is next to be decoded.

The 2 Special Function Bits: The first of these two bits is latched upon pressing the button on the personal locator transmitter. This bit is meant as a call for help when received by the processor on the receiving end. Bit two appears in the data stream, following bit one, if the strap is cut. In this case the alarm received raises the alarm, identifying a violation in the transmitter has already happened.

The 21 Bits Programmable EEPROM Cells: These cells (or bits) can all or partly be used to program an identification number. Utilizing the binary format, the memory can have up to $2^{21}=2\ 097\ 152$ choices of identification numbers. This is in addition to the four sync bits and the two special function ones.

The 4 Bits EEPROM Case Select: These four bits are for the purpose of selecting the case in the read mode, often being programmed with the proper code as specified in program mode.

As previously mentioned, the time diagram (FIG. 14) shows all cases at both 2.8 KHz and 1.4 KHz, provided the oscillator is running at 5.6 KHz. The oscillator frequency is determined by hardwiring the oscillator parts to the proper values of external resistors and capacitor. With the choice of different values of these resistors, the oscillator could run at a different frequency, it will then be possible to obtain all cases B to E identical in patterns with different timings.

Figure 12:
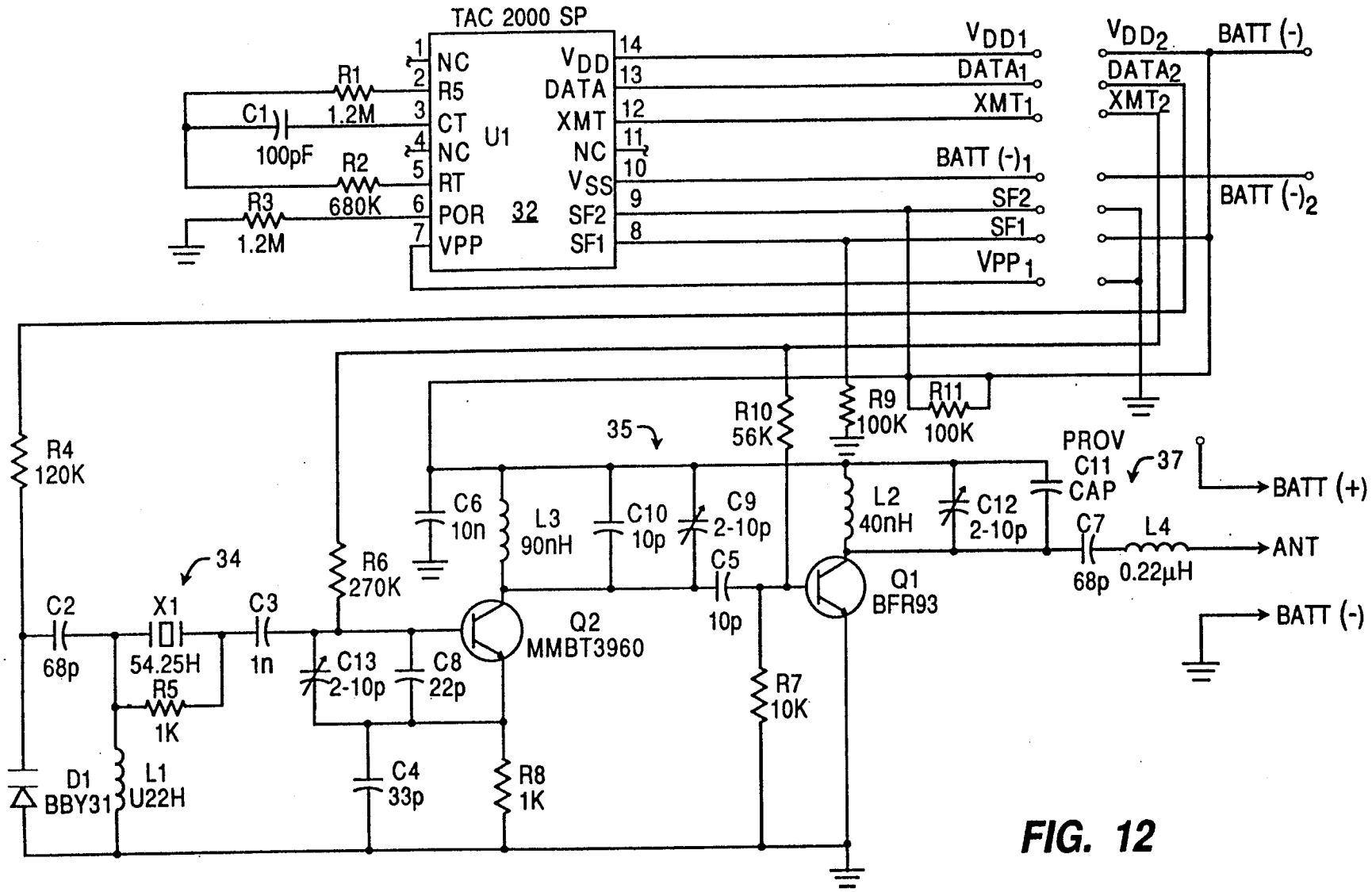
Figure 13:
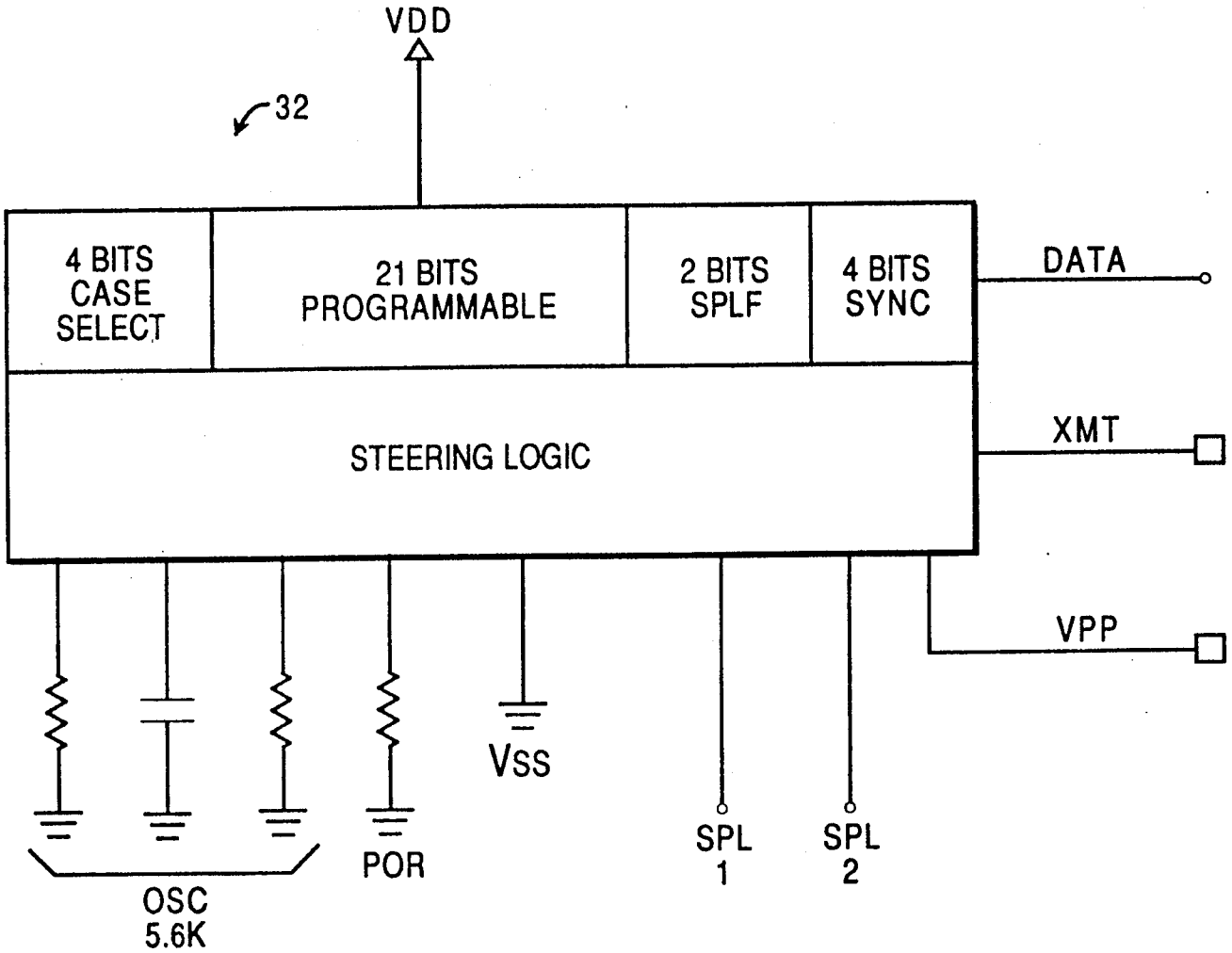

When the battery (not shown) is first connected to the circuitry, shown in FIG. 12, the power on reset function built into the EEPROM will put the memory in its initial status. The read cycle will then continue to be repeated accurately and periodically.

The general specifications for the transmitter components are shown in Table 1 below:

TABLE 1

| | |
|---|---|
| Frequency: | 217 MHz |
| Stability: | +/−5 PPM |
| Bandwidth: | 3.6 KHz |
| Carrier Type: | Pulsed FSK (as per time diagram) |
| Pulse Width: | Pulsed FSK (as per time diagram) |
| Pulse Rate: | Pulsed FSK (as per time diagram) |
| Duty Cycle: | Pulsed FSK (as per time diagram) |
| Spurious Emission: | >40 db |
| Harmonic Reduction: | >15 db (depending upon antenna loading) |
| Antenna: | 300° circular |
| Power Output: | 1 mW (Minimum) |
| Current Drain: | 5 mA (average: transmission made) |
| Operating Voltage: | 3.2 V to 2.2 V |
| Battery Life: | Depending on case (4 months minimum) |

The actual components in an operating embodiment of the invention are illustrated in FIG. 12 all components being identified by their value or by model numbers, the EEPROM is of course a proprietary device specially formulated for the present application.

As seen in the timing diagram (FIG. 14), the XMT (transmit enable) will go high: transmitter is on. After a waiting time of 11.42 mS (the preamble), this is for the carrier to be present before the data is introduced. At the end of the preamble time, four sync bits and the two Special Function bits will appear in the data stream. This will be followed by 10 data bits, which carry the ID number in the binary format. At the end of the 10th bit the data goes to zero for 2.86 mS (time between code groups). Then the second code group will start (without the preamble). This is followed by a second zero level, which is the time between the code groups: 2.86 mS. Then the third code group follows. At the end of the third code group the XMT (transmit enable) goes to zero turning off the transmission for a period of 1.096 seconds. The same cycle is repeated periodically. The time between the transmission bursts, 1.096 seconds, is only for the purpose of power saving in order to extend the battery life. A block diagram of the whole transmitter is included herewith in FIG. 12.

OUTPUT POWER OF THE TRANSMITTER

The usual output radiated power of the transmitter is an average of 1 mW. This power level could be stepped up (according to application). The following are the choices:

A - 2 mW output by modifying the biasing on the second multiplier stage

B - 5 mW output by using an additional transistor as output driver operating in class C C - 5 or 25 mW by the use of a specially designed output buffer, as shown in the block diagram.

The features of the present embodiment of the invention give this design a number of advantages over existing personal locator transmitters. The most important of these features include:

The transmitter is light in weight and small in size, no bigger than a wrist-watch. The transmitter can only be removed from the wrist by using a special key. If the strap is cut the transmitter sends a panic alarm. Additionally, a call for help may be initiated by the wearer by pressing an appropriate button on the face of the unit. The unit is capable of storing a large number of separate identifications, up to $2^{21}$ or 2,097,152 separate ID's. Accordingly a large number of users may be present in the same facility.

Since the memory control unit is an EEPROM, the units may be reprogrammed by removal of the EEPROM, insertion in suitable reprogramming device (EEPROM blaster) and reprogrammed to have the desired data characteristics. Time between transmission bursts can be varied from 1.09 to 11.7 seconds for extended battery life and different applications. The special type of antenna, being a 300° circular shape, allows multi-plane propagation patterns. This is advantageous in the sense where no matter the position of the wrist, the RF propagation will reach the received antenna. In view of the large number of programming choices, the personal locator transmitter can be programmed to cases with two or three code groups. This enables various detection configurations to be utilized, such as receivers which are selective for only certain code groups and ignore all others. This depends on the number of code groups and the system architecture. Alternately, other receivers can be programmed to decode signals ignored by other receivers notwithstanding that the whole system is operated on one transmitter frequency. With the choice of the slow operating cases (B or E at 1.4 KHz) the battery life could be extended to as long as six months.

The range of possible uses of the personal locator transmitter is very wide. Typical applications include patient monitoring in hospitals; old aged care, both in the home and in institutions; protection of children against abduction; home alert applications which are triggered by a person leaving the home which operates a home security unit to dial a certain telephone number or alert a control centre. In the trucking industry, the transmitter may be located on a truck or its operator and the receiver on the exit/entrance gate for the shipping yard can record the times and identities of trucks and drivers entering and exiting the yard. In cases of use in the home arrest program, the receiver will be listening to transmitter signals at all times. If the person under house arrest leaves the house, the receiver will alert the monitoring centre. The personal locator transmitter can also be included in packages sent by mail or courier services to easily locate specified packages by their individual identification numbers.

What is claimed is:

1. A personal locator device adapted to be worn on the wrist and having the size and appearance of a conventional wrist-watch and including a molded casing and an integral strap extending therefrom, said casing containing a programmable memory, a transmitter controlled by said programmable memory, an omni-directional antenna, a back plane, and a battery, said integral wrist strap having a free end, said free end being adapted for insertion through a slot in said casing, a metal strip extending from said casing through said integral strap, means for locking said free end in said casing, said locking means including an electrical contact for contacting said metal strip when said free end is engaged therein, to complete a circuit, interruption of said circuit causing an alarm code to be transmitted by said transmitter.

2. A personal locator transmitter as claimed in claim 1 and including manually operable means for generating said alarm code transmitted by said transmitter.

3. A personal locator transmitter as claimed in claim 1 wherein said bursts of data on a continuous basis under control of said programmable memory.

4. A personal locator transmitter as claimed in claim 3 wherein said programmable memory includes means for turning said transmitter on at pre-determined intervals, and means for modulating the carrier of said transmitter with a pre-determined binary coded data stream.

5. A personal locator transmitter as claimed in claim 1 wherein said programmable memory is an EEPROM.

6. A personal locator transmitter as defined in claim 1 wherein said programmable memory and said transmitter are mounted on a printed circuit board within said casing.

* * * * *